United States Patent [19]

Seitzer

[11] 4,166,023

[45] Aug. 28, 1979

[54] POUR POINT DEPRESSANT FOR SHALE OIL

[75] Inventor: Walter H. Seitzer, West Chester, Pa.

[73] Assignee: Sunoco Energy Development Company, Dallas, Tex.

[21] Appl. No.: 905,694

[22] Filed: May 15, 1978

[51] Int. Cl.[2] ..... C10G 1/02

[52] U.S. Cl. ..... 208/14; 208/11 R

[58] Field of Search ..... 208/11 R, 14

[56] References Cited

U.S. PATENT DOCUMENTS

| | | | |
|---|---|---|---|
| 2,757,129 | 7/1956 | Reeves et al. | 201/29 |
| 3,162,583 | 12/1964 | Hemminger et al. | 208/11 R |
| 3,523,071 | 8/1970 | Knapp et al. | 208/14 |
| 3,532,618 | 10/1970 | Wunderlich et al. | 208/14 |

*Primary Examiner*—Herbert Levine

*Attorney, Agent, or Firm*—J. Edward Hess; Donald R. Johnson; Anthony Potts, Jr.

[57] ABSTRACT

A process for producing a mixture of shale oils containing spherulites which comprises adding an effective amount of an about 1050° F. plus fraction of a raw shale oil containing spherulites, e.g. prepared by a solid-upflow fluid-downflow oil shale retorting process, to a waxy shale oil not containing spherulites, e.g. prepared by a solid-downflow fluid-upflow oil shale retorting process. The formation of spherulites in the mixture is accompanied by a lowered reduction in the pour point of the resulting shale oil mixture.

15 Claims, 3 Drawing Figures

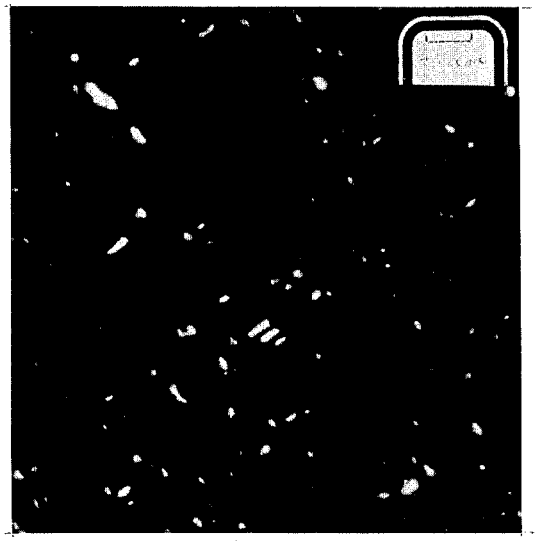
FIGURE I
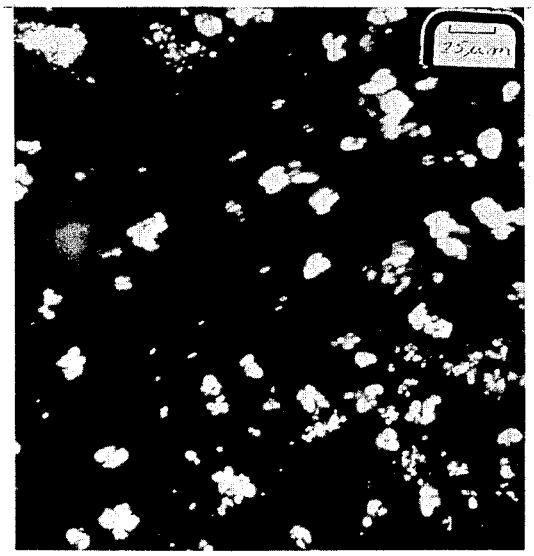
FIGURE II
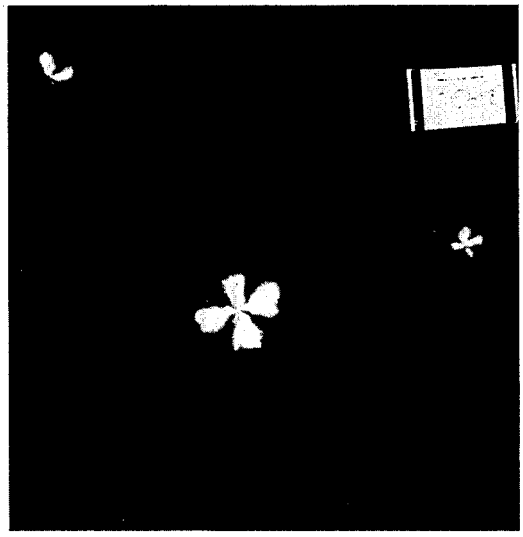
FIGURE III

POUR POINT DEPRESSANT FOR SHALE OIL

FIELD OF THE INVENTION

The present invention is directed to the reduction of the pour point of shale oil. Particularly, the invention is concerned with the reduction of the pour point of a waxy shale oil not containing spherulites e.g. a shale oil prepared from retorting oil shale via a solid-downflow fluid-upflow (referred to hereinafter as SDFU) process. More particularly, the invention is directed to reducing the pour point of a waxy shale oil prepared from retorting oil shale via a SDFU retorting process using a particular heavier fraction obtained from a raw shale oil containing spherulites e.g. a shale oil prepared from retorting oil shale via a solid-upflow fluid-downflow (referred to hereinafter as SUFD) process. Further, the invention is directed to a composition of a mixture of shale oils of a waxy shale oil prepared via a SDFU retorting process and a heavier fraction of a shale oil prepared from a SUFD retorting process. Still further, the invention is directed to a process of preparing a low pour point shale oil mixture.

DESCRIPTION OF THE PRIOR ART

A general description of shale oil and how it is obtained from oil shale via various retorting methods is disclosed in Kirk-Othmer, *Encyclopedia of Chemical Technology,* 2nd Edition, Volume 18. Particular methods of obtaining shale oil from shale oil are described in numerous U.S. Patents contained, in part, in U.S. Classes 208-11 and 201-29. A representative example of Class 208-11 is U.S. Pat. No. 3,841,992 which discloses a process in which solids are moved continuously downward in a vertical column and gas and product continuously moved upwardly in the same column. U.S. Pat. No. 3,361,644, Class 201-29, discloses a process in which oil shale is fed upwardly through a vertical retort by means of a reciprocating piston and gas and product flow downward.

Raw shale oil, generally as directly obtained from oil shale, has a pour point which is too high for liquid transportation. The pour point, about 60°–100° F., is higher than the ambient temperature during most of the year, and thus the shale oil tends to solidify.

U.S. Pat. No. 3,523,071, Class 208-14, discloses a process for reducing the pour point of a raw shale oil. The process involves separating the shale oil into two portions and hydrodenitrogenating the first portion and visbreaking the second portion. The heavy portion of the visbroken shale oil (1000° F. plus) reduces the pour point, when blended with the hydrodenitrogenated shale oil or with the hydrodenitrogenated light visbroken shale oil.

U.S. Pat. No. 3,532,618, Class 208-14, discloses a process for reducing the pour point of a raw shale oil and preparing a pour point depressant. Shale oil having a pour point of +85° F. is hydrovisbroken, thereby reducing its pour point to −45° F. The hydrovisbroken material is then mixed with n-pentane, centrifuged and a heavy viscous layer is obtained. The latter contains a pour point depressant for shale oil and which can be added to a shale oil having a pour point of above about 20° F. to obtain a shale oil composition of lowered pour point.

U.S. Pat. No. 3,738,931, Class 208-67, discloses a method for treating a synthetic crude oil, including a raw shale oil, to reduce its pour point. The method involves visbreaking the crude oil, separating vapors from the visbroken oil, hydrogenating the vapors and combining the latter with the unvaporized oil, thereby providing an oil product suitable for conventional transportation.

U.S. Pat. No. 3,284,336, Class 208-11, discloses a method for lowering the pour point of a raw shale oil involving thermal treatment of the oil. The shale oil is fractionated into a light fraction and a residue. The residue is then heat treated at a temperature of about 700° F. for about one hour and then recombined with the high fraction. The resulting recombined oil has a substantially lower pour point (compared to the untreated oil) and the actual lowering depending on the temperature of the heat treatment and its duration.

U.S. Pat. No. 3,018,243, Class 208-11, discloses a process for producing a shale oil having a low pour point. The process involves pyrolyzing oil shale to produce effluent oil vapors and gases, cooling the effluent to a certain temperature to condense the heavier fractions contained therein and via recycling, thermally cracking the heavier fractions to a certain extent. The uncracked lighter fractions and the cracked heavier fractions are condensed together to produce a composite oil product having a lower pour point. U.S. Pat. No. 3,034,979, Class 208-11, discloses a variation of the foregoing process.

The foregoing processes all involve thermally treating the shale oil or certain portions and thereby have the disadvantage of reducing liquid yields because of some cracking and/or coking. Further, all consume large amounts of energy.

In lubrication technology it is known that a small amount (~1.0%) of an additive such as polymethacrylate or a polymer formed by condensation of wax with naphthalene or phenol acts as a pour point depressant when combined with a low-viscosity paraffinic oil. However, such an additive is generally expensive which limits its use in relatively low value products.

SUMMARY

The present invention can be briefly described and summarized as involving the separation of an about 1050° F. plus fraction of raw shale oil obtained from raw shale oil containing spherulites e.g. one prepared via a SUFD process. The separated 1050° F. plus fraction is a pour point depressant which when added to a shale oil not containing spherulites, e.g. one prepared by a SUFD process, causes the resulting mixture of shale oils to have a pour point lower than that of the major component. Thus, the process avoids a costly and energy consuming visbreaking step and has the advantage of simplicity.

Further, the 1050° F. plus fraction can be treated with n-pentane and the n-pentane insoluble fraction can be added to a waxy shale oil not containing spherulites. The resulting mixture of the waxy shale oil and the insoluble fraction has a pour point lower than that of the major component, i.e., the waxy shale oil.

In connection with the foregoing pour point reduction, it has been observed that the addition of the about 1050° F. plus fraction from a raw shale oil containing spherulites, including its n-pentane insoluble fraction, to a waxy shale oil prepared by a non-SUFD process results in the formation of waxy spherulites. By itself, the wax crystals of the higher pour point waxy shale oil prepared via a non-SUFD process appear as needles and plates. Thus, it appears that the presence of waxy spherulites is associated with a low pour point shale oil whereas the presence of waxy needles is associated with the opposite.

BRIEF DESCRIPTION OF THE FIGURES

FIG. I is a photograph of a sample, under a polarizing microscope, of a whole raw shale oil prepared by a SDFU process. This sample shows the generally formed waxy needles.

FIG. II is a photograph, under the same previously mentioned conditions, of a sample of a whole raw shale oil prepared by a SUFD process. This sample shows the spherulites referred to in this application.

FIG. III is a closeup photograph which focuses in on one spherulite.

DESCRIPTION

Raw shale oil is obtained from oil shale by subjecting oil shale to a high temperature, e.g., 600°–1200° F. The high temperature is caused by external or internal application of heat. Generally the heating process involves retorting and often involves the presence of air in the retorting zone. The retorting processes can be characterized by the relative flows of solid and fluids. One retorting process can be described wherein the solids flow downward, whereas the fluids, i.e., the vapors, gases and liquids, flow upward. Separation of the upflowing fluids can be accomplished by known means. This process is further described in the aforementioned encyclopedia, and is still further described in U.S. Pat. No. 2,885,338, Class 208–11. And as indicated heretofore, this type of process is referred to as a SDFU process. This process can also be described as one member of a non-SUFD process. Other members would include, e.g., horizontal moving beds. The waxy oil prepared from the foregoing processes is characterized by the absence of spherulites.

Another retorting process can be one wherein the solids are forced upward while the fluids travel downward. The fluids by passing downward, contact the cooler oil shale towards the bottom of the retort and the condensables condense out and are removed at the bottom. This process is further described in the aforementioned encyclopedia and is still further described in U.S. Pat. Nos. 3,133,010, Class 208–11, or 4,025,416, Class 208–11R. And as indicated heretofore, this type of process is referred to herein as a SUFD process. Both the SUFD and SDFU processes can be internally and/or externally heated.

Shale oil as produced by a non-SUFD process generally has a high pour point, e.g., about 60°–100° F.; see examples for description of other properties. And for ease of transportation via pumping and pipeline, its pour point has to be lowered. The shale oil could be treated, e.g., with hydrogen to lower sulfur and/or nitrogen, but it still would retain its high pour point.

Applicant's process can reduce the high pour point of raw or treated waxy shale oil not containing spherulites. Applicant's process involves taking a raw shale oil containing spherulites generally using a SUFD process and separating out an about 1050° F. plus fraction. An about 1050° F. plus fraction refers to the material left behind in the pot of a still after all the material boiling below about 1050° F. (the 1050° F. minus material) has been heated off. The 1050° F. plus fraction then can be further treated by mixing it with n-pentane at room temperature and separating the liquid containing the solubles (resins) from the remaining undissolved solids (asphaltenes). The remaining undissolved solids, the n-pentane-insoluble fraction, can also be used as a pour point depressant.

After separation of a 1050° F. plus fraction from raw shale oil containing spherulites it can be added to a raw or treated waxy shale oil prepared by a non-SUFD process. The amount of the 1050° F. plus fraction (or its n-pentane insoluble portion) is sufficient or effective to lower the pour point of the waxy shale oil. The aforementioned mixture, as a result of the addition, contains spherulites, thereby indicating a relative reduction in pour point.

In addition to the process for producing the aforementioned mixtures, applicant's invention is also directed to the mixture itself. The resulting mixture contains spherulites. The mixture consists of two portions, one an about 1050° F. plus fraction of raw shale oil obtained from a raw shale oil prepared e.g. by a SUFD retorting process, and in amount sufficient or effective to cause the formation of spherulites. In a preferred embodiment the 1050° F. plus fraction is present in a minor amount. The other portion of the mixture is a major amount of a waxy shale oil or a portion thereof not prepared by a SUFD retorting process. The mixture can also comprise the pentane insoluble portion of the 1050° F. plus fraction and the shale oil. The waxy shale oil can be a raw oil or it can have been processed by various means.

While the preferred method involves the addition of 1050° F. plus fraction to the waxy shale oil not containing spherulites, substitution of 1050° F. plus fraction for various fractions of the waxy shale oil is a less preferred method. The substitution approach is favored when a higher value alternative use can be found for the fraction being substituted.

The following examples are given to specifically illustrate embodiments of the method of the invention. Also given are comparative examples.

EXAMPLES

Accompanying Table I presents comprehensive analytical examinations of raw Utah shale oils, one prepared by a SDFU process, the other by a SUFD process. Both raw shale oil products appeared to be quite similar, both physically and chemically. However, there are major differences in their respective pour points; +27° F. to +30° F. for the oil from a SUFD process and +77° F. for an oil from a SDFU process.

In a polarizing microscope a sample of a raw shale oil prepared by a SUFD process contains wax crystals which appear as the expected needles and plates; see FIG. I. In contrast, most of the crystals of a sample of a raw shale oil prepared by a SDFU process exhibit properties characteristic of spherulites of anisotropic materials, although some needles are present; see FIG. 11. The spherulites are round, and between crossed polars in parallel light, display a black maltese cross which remains stationary on rotation of the stage. FIG. III is an enlargement focusing in on one spherulite. X-ray examination of both oils gave only the pattern for paraffinic wax.

The wax from the raw shale oil was isolated by removing pentane-insolulbes from a 650 plus fraction, precipitating the crude wax in methlyethylketone-toluene, deoiling the wax in ethylene dichloride. The yields, based on total oil, were about 5% for the SDFU oil and about 4.7% for the SUFD oil.

TABLE I

Comprehensive Analysis of Raw Utah Shale Oils Prepared by SDFU and SUFD Processes

| Analysis | SUFD | SDFU |
|---|---|---|
| Gravity, °API | 20.2 | 19.6 |
| C, wt.% | 84.27 | 84.21 |
| H, wt.% | 11.68 | 11.82 |
| O, wt.% | 1.23 | 1.89 |
| S, wt.% | 0.55 | 0.50 |
| $N_t$, wt.% | 1.93 | 2.09 |
| $N_b$, wt.% | 1.26 | 1.19 |
| Ash, wt.% | 0.3 | 0.05 |
| C.C Residue, wt.% | 4.3 | 3.1 |
| Pour Point °F. | +27,+30 | +75,+77 |
| Vis, at 100° F., cs | 35.3 | 60.9 |
| Vis, at 210° F., cs | 4.83 | 5.95 |
| Cl, ppm | 5 | 6 |
| As, ppm | 49 | 19 |
| Chemical Structure[a] | | |
| Paraffins, wt.% | 9 | 7 |
| Naphthenes, wt.% | 10 | 10 |
| Olefins, wt.% | 7 | 5 |
| Aromatics | 45 | 44 |
| Polar Aromatics | 24 | 29 |
| Pentane Insol. | 5 | 5 |
| Distillation[b] | | |
| IBP | 152 | 220 |
| 10 | 345 | 503 |
| 30 | 633 | 690 |
| 50 | 799 | 827 |
| 70 | 919 | 952 |
| 90 | 1078 | — |
| EP | 1100 | 1100 |
| % Distilled | 92 | 87 |

[a]ASTM D-2007
[b]ASTM D-1160

Gas chromatography analysis indicated that both waxes were quite similar, although their melting points were different, 109° F. and 140° F. respectively. Thus, it would appear that difference in the waxes does not materially effect the formation of spherulites.

Also a raw shale oil from a SUFD process has a higher ash, 0.3 wt. % compared to 0.05 wt. % for the other oil. As expected, the higher ash oil contained many observed mineral particles. Removal of these particles from the SUFD oil did not seem to effect the formation of spherulites.

Certain fractions were distilled out of a sample of raw shale oil obtained from a SUFD process to determine, if any, their effect on pour point and the presence of spherulites. The following Table II summarizes the results.

TABLE II

Presence of Spherulites in Different Fractions

| SUFD Composition | Presence of Spherulites in the Composition | Pour Point, °F. |
|---|---|---|
| Whole Raw Shale Oil | Yes | +27 |
| Less a 650°-750° F. fraction | Yes | − 3 |
| Less a 750°-850° F. fraction | Yes | −23 |
| Less a 850°-950° F. fraction | No | −20 |
| Less a 850°-1050° F. fraction | No | — |
| Less a 950°-1050° F. fraction | Yes | − 3 |
| Less a 1050° F.+ fraction | No | +62 |

The lack of spherulites in the raw shale oil less the 850°-950° F. and the 850°-1050° F. are believed to be caused by the removal of wax necessary to form spherulites rather than the lack of a material which causes the wax to form as spherulites.

The data in the foregoing Table II suggests that a 1050° F. plus fraction of the shale oil obtained by a SUFD process contains a material which causes the wax to crystallize as spherulites rather than a network of needles and thereby decreases the pour point.

The data of accompanying Table III shows the effectiveness of a SUFD 1050° F. plus fraction (a solid at room temperature) as a pour point depressant when used in combination with a raw shale oil prepared by a SDFU process. Compositions 1 and 2 are the two raw shale oils prepared by SDFU and SUFD processes, respectively. The SDFU oil has a high pour point of +77° F. whereas the SUFD oil has a low pour point of +27° F.

TABLE III

EFFECTIVENESS OF SOLID-UPFLOW FLUID-DOWNFLOW (SUFD) FRACTION AS A POUR POINT DEPRESSANT

| Compositions | Presence of Spherlites? | Pour Point, °F. |
|---|---|---|
| 1. SDFU raw shale oil | No | +77 |
| 2. SUFD raw shale oil | Yes | +27 |
| 3. SDFU + 5 wt. % of 1050° F.+SUFD | Yes | +38,-+44 |
| 4. SDFU + 10 wt. % of 1050° F.+SUFD | Yes | +21 |
| 5. SDFU less its 1050° F.+ but replace by 1050° F.+ SUFD | Yes | +21 |
| 6. SDFU + 5 wt. % of 1050° F.+SDFU | No | +69 |
| 7. SUFD + 4 wt. % of 1050° F.+SDFU | Yes | +42 |
| 8. SUFD + 10 wt. % of 1050° F.+SDFU | No | +48 |
| 9. SUFD less its 1050° F.+ but plus 1050° F.+ SDFU | No | +58 |
| 10. SUFD + 9 wt. % of additional I-425 | Yes | +36 |

Comparison of pour points of compositions 1 and 3 indicate that the addition of a 5 wt. % of a 1050° F. plus oil of a SUFD process to a raw shale oil prepared by a SDFU process lowers the pour point from +77° F. to about +38 to +44° F. Comparison of compositions 1 and 4 indicate that the pour point is lowered from +77° F. to +21° F. upon the addition of 10 wt. % of a 1050° F. plus SUFD fraction. Comparison of compositions 1 and 5 indicate that substitution of the 1050+ fraction of the SDFU oil by an equal amount of a 1050+ SUFD fraction also results in the reduction of pour point.

Comparison of compositions 1 and 6 indicates that the addition of 5 wt. % of a 1050° F.+ SDFU fraction to a SDFU raw shale oil causes only a slight reduction in pour point, but without the formation of spherulites.

Comparison of compositions 2 and 7 indicates that the addition of 4 wt. % of a 1050° F.+ SDFU fraction to a SUFD raw shale oil raises the pour point. Comparison of compositions 2 and 8 indicates that the addition of 10 wt. % of a 1050° F.+ SDFU fraction, raises the pour point and eliminates the presence of spherulites.

In composition 9 all of the 1050° F.+ fraction (8.7 wt. %) was removed from a SUFD oil and replaced with the 1050° F.+ fraction from a SDFU oil (8.7%). Again, spherulites were not present. In composition 10 a light fraction (Initial-425) of SUFD was added to whole SUFD oil but the pour point increased compared to composition 2.

Comparative runs were made to determine the effect of various processing treatments on the absence of spherulites in a raw shale oil prepared by a SDFU process. Accompanying Table IV summarizes the results.

TABLE IV

EFFECT OF VARIOUS TREATMENTS ON ABSENCE OF SPHERULITES IN A SDFU RAW SHALE OIL

| Composition | Presence of Spherulites | Pour Point °F. |
|---|---|---|
| SDFU raw shale oil | No | +77 |
| SDFU + 5 wt.% of 1050° F.+ SDFU | No | +69 |
| SDFU + 5 wt.% of H.T. 1050° F.+ SDFU | No | +68 |
| SDFU less its 1050° F.+ plus H.T. 1050° F.+ SDFU | No | +57 |
| SDFU less 650°-1050° F. plus H.T. 650°-1050° F. | No | +68 |

The heat treated (H.T.) fractions were processed in a stirred reactor at about 730° F. for about 1.5 hours under about a hundred pounds pressure. The foregoing data in Table IV indicates that thermal cracking of the bottoms or certain fractions does lower the pour point of a SDFU raw shale oil somewhat but does not obtain it by the formation of spherulites.

The distillations employed in the examples were conducted according to ASTM D-1160-52T. Pour points were measured on a Mectron Autopour.

The invention claimed is:

1. A mixture of shale oils containing spherulites comprising:
   (a) an about 1050° F. plus fraction of raw shale oil obtained from a raw shale oil containing spherulites and in an amount sufficient to form spherulites in portion (b);
   (b) a waxy shale oil not containing spherulites.

2. A mixture of shale oils according to claim 1 wherein the (a) fraction is a n-pentane-insoluble fraction of the about 1050° F. plus fraction.

3. A mixture of shale oils according to claims 1 or 2 wherein the raw shale oil is prepared by a solid-upflow fluid-downflow retorting process.

4. A mixture of shale oils according to claims 1 or 2 wherein the raw shale oil is prepared from a fluid-downflow retorting process and the waxy shale oil is prepared from a solid-downflow fluid-upflow retorting process.

5. A mixture of shale oils according to claims 1 or 2 wherein a minor amount of the 1050° F. plus fraction is present.

6. A process for producing a mixture of shale oils containing spherulites comprising:
   (a) separating an about 1050° F. plus fraction from a raw shale oil containing spherulites; and
   (b) adding, in an amount sufficient to form spherulites, the separated 1050° F. plus fraction to a waxy shale oil not containing spherulites.

7. Process according to claim 6 wherein the (a) fraction is first contacted with n-pentane and is then separated from the n-pentane containing the solubles and the remaining n-pentane insoluble fraction is added to the waxy shale oil of (b).

8. Process according to claims 6 or 7 wherein the raw shale oil is prepared by a solid-upflow fluid-downflow retorting process.

9. Process according to claims 6 or 7 wherein a minor amount of the 1050° F. plus fraction is present.

10. Process according to claims 6 or 7 wherein the raw shale oil is prepared by a solid-upflow fluid-downflow retorting process.

11. In the process for producing a mixture of shale oils containing spherulites the improvement comprising the addition of an about 1050° F. plus fraction of a raw shale oil containing spherulites to a waxy shale oil not containing spherulites.

12. Improvement according to claim 11 wherein the addition is of an n-pentane-insoluble fraction of the about 1050° F. plus fraction.

13. Improvement according to claims 11 or 12 wherein the raw shale oil is prepared by a solid-upflow fluid-downflow retorting process.

14. Improvement according to claims 11 or 12 wherein the raw shale oil is prepared by a solid-upflow fluid-downflow retorting process and the waxy shale oil is prepared by a solid-downflow fluid-upflow retorting process.

15. Improvement according to claims 11 or 12 wherein a minor amount of the 1050° F. plus fraction is present.

* * * * *